US006753644B1

(12) United States Patent
Iwasaki

(10) Patent No.: US 6,753,644 B1
(45) Date of Patent: Jun. 22, 2004

(54) COLOR CATHODE-RAY TUBE AND COLOR CATHODE-RAY TUBE APPARATUS

(75) Inventor: Katsuyo Iwasaki, Hyogo (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 173 days.

(21) Appl. No.: 09/675,121

(22) Filed: Sep. 28, 2000

(30) Foreign Application Priority Data

Nov. 2, 1999 (JP) ..... 11-311998

(51) Int. Cl.[7] ..... H01J 29/50

(52) U.S. Cl. ..... 313/413; 313/412; 313/428; 313/433; 313/442

(58) Field of Search ..... 313/413, 412, 313/428, 433, 440, 442

(56) References Cited

U.S. PATENT DOCUMENTS

| | | | | | |
|---|---|---|---|---|---|
| 4,142,131 | A | * | 2/1979 | Ando et al. | 315/368.25 |
| 4,346,327 | A | | 8/1982 | Barten | 313/413 |
| 4,396,862 | A | | 8/1983 | Hughes | 313/413 |
| 4,728,915 | A | | 3/1988 | Konosu et al. | 335/211 |
| 4,962,333 | A | * | 10/1990 | Sluyterman | 313/440 |
| 5,179,319 | A | * | 1/1993 | Iwasaki et al. | 313/440 |
| 5,225,736 | A | * | 7/1993 | Fujiwara et al. | 313/440 |
| 5,598,055 | A | * | 1/1997 | Inoue et al. | 313/440 |
| 5,770,932 | A | * | 6/1998 | Nakane | 313/412 |
| 5,777,429 | A | * | 7/1998 | Headley | 313/440 |
| 5,811,922 | A | * | 9/1998 | Yi | 313/440 |
| 6,194,824 | B1 | * | 2/2001 | Ueda | 313/413 |
| 6,380,667 | B1 | * | 4/2002 | Yokota et al. | 313/440 |

FOREIGN PATENT DOCUMENTS

| | | |
|---|---|---|
| JP | 53-147436 | 12/1978 |
| JP | 54-146572 | 11/1979 |
| JP | 57-28451 | 6/1982 |
| JP | 57-168455 | 10/1982 |
| JP | 57-172636 | 10/1982 |
| JP | 58-225543 | 12/1983 |
| JP | 63-897 | 1/1988 |
| JP | 2-6188 | 2/1990 |
| JP | 3-54420 | 8/1991 |
| JP | 5-36894 | 6/1993 |

* cited by examiner

*Primary Examiner*—Ashok Patel
*Assistant Examiner*—Kevin Quarterman
(74) *Attorney, Agent, or Firm*—Merchant & Gould, P.C.

(57) ABSTRACT

A color cathode-ray tube including an in-line electron gun and a color cathode-ray tube apparatus including the same are provided. At an end, on a screen side, of the electron gun, two pairs of members for generating a magnetic field are placed above and below side beams of three electron beams so as to sandwich them, respectively. Between each of the two pairs of members for generating a magnetic field, a localized barrel magnetic field is formed to vary cross-sectional shapes of the side beams positioned on both sides of a center beam so that the cross-sectional shape of one of the side beams is horizontally or vertically elongated to a higher degree than that to which the cross-sectional shape of the other of the side beams is. Magnetic fields for reverse correction of spot distortions of the side beams are generated and therefore the symmetry in the spot distortions of the side beams asymmetric with each other is improved, thus improving focus quality.

15 Claims, 12 Drawing Sheets

COLOR CATHODE-RAY TUBE AND COLOR CATHODE-RAY TUBE APPARATUS

BACKGROUND OF THE INVENTION

1. Field of the Invention

The present invention relates generally to a color cathode-ray tube with an in-line electron gun and a color cathode-ray tube apparatus using the same.

2. Related Background Art

In a color cathode-ray tube apparatus provided with an in-line electron gun, a horizontal deflection magnetic field and a vertical deflection magnetic field are provided with strong pincushion (FIG. 8) and barrel (FIG. 9) distortions, respectively, for the purpose of self-convergence. The influences accompanying this are found in focus and convergence. In other words, as shown in FIG. 12, the shapes of beam spots, which rightfully should be perfect circles, are distorted due to deflections as follows. In the upper and lower portions of the screen, the shapes of beam spots are horizontally elongated and also are rotated. In the left and right portions of the screen, they are horizontally elongated, wherein the distortion levels are different between side beams, and haze (indicated with broken lines in FIG. 12) is caused due to upward and downward blurs of beam spots. At the diagonal corners of the screen, the beam spots have shapes such as those obtained when the horizontally long shapes are rotated and furthermore, the sizes of haze areas are different between side beams. Any of the above is one of the factors causing the deterioration in image quality. Furthermore, with respect to the convergence, the convergent point of a center beam (G) is different from those of side beams (B, R), which has caused color position shifts (not shown in figures).

In view of such occurrences, conventionally, in order to improve the convergence of three-color beam spots and the shapes of the beam spots in the upper and lower portions of a screen simultaneously, for example, JP 5-36894 B discloses a method in which magnetic pieces are attached to a rear end portion of a deflection yoke and a rear end part of a vertical magnetic field is distorted locally in a pincushion form.

In order to improve the convergence of the center beam relative to that of the side beams in the upper, lower, left and right portions of the screen, for example, JP 57-172636 A and JP 54-146572 A employ a method in which magnetic pieces are provided at an end of an electron gun and the strength of a magnetic field acting on the center beam is varied relative to the strengths of magnetic fields acting on the side beams, thus adjusting the convergence.

In the aforementioned conventional inventions, however, spot distortions in the left and right portions of the screen and the asymmetry in the spot distortions of side beams with respect to each other cannot be corrected, although the convergence of the center beam relative to those of the side beams and the spot shapes in the upper and lower portions of the screen are improved. Thus, the problem of the deterioration in image quality has remained.

This is described with reference to FIG. 11. When beams travel in a direction from the back side to the front side of the paper and are deflected to the right, a pincushion magnetic field is directed upward. In this case, beams B, G and R are subjected to a deflection force and at the same time, a distortion force causing the spot shapes of the beams to be horizontally elongated by a force in a direction perpendicular to that of the magnetic field. Since the beam R is positioned to the right with respect to the beam B, it therefore is subjected to a constant and strong distortion effect, which makes the shape of the beam R horizontally longer, thus causing the asymmetry of the beams B and R with respect to each other, as to the degrees to which their spot shapes are horizontally elongated.

SUMMARY OF THE INVENTION

In view of the above-mentioned points, the present invention is intended to provide a color cathode-ray tube and a color cathode-ray tube apparatus that enable focus quality to be improved by generating magnetic fields, on a neck side, with respect to three beams, respectively, for reverse correction of spot distortions to improve the symmetry in the spot distortions of side beams asymmetric with each other.

A first color cathode-ray tube of the present invention includes an in-line electron gun. In the first cathode-ray tube, side beams of three electron beams are allowed to pass through localized barrel magnetic fields formed in a direction substantially perpendicular to an in-line plane and corresponding to the side beams, respectively. Thus, cross-sectional shapers of the side beams are varied so that the cross-sectional shape of one of the side beams is horizontally or vertically elongated to a higher degree than that to which the cross-sectional shape of the other of the side beams is.

According to this, before the electron beams enter a deflection magnetic field, the cross-sectional shapes of the electron beams are varied depending on the asymmetry in the spot shapes of the side beams with respect to each other. Therefore, the nonuniformity in the spot shapes can be improved.

A second color cathode-ray tube of the present invention includes an in-line electron gun. In the second color cathode-ray tube, at the end, on a screen side, of the electron gun, two pairs of members for generating a magnetic field are placed above and below side beams of three electron beams so as to sandwich them, respectively. Between each of the pairs of members for generating a magnetic field, a localized barrel magnetic field is formed to vary cross-sectional shapes of the side beams so that the cross-sectional shape of one of the side beams is horizontally or vertically elongated to a higher degree than that to which the cross-sectional shape of the other of the side beams is.

According to this, the side beams are subjected to the localized barrel magnetic fields before entering a deflection yoke, thus varying the cross-sectional shapes of the side beams.

In the second color cathode-ray tube, it is preferable that the strength of the localized magnetic field formed between each of the pairs of members for generating a magnetic field varies depending on the level of horizontal deflection.

This enables the strengths of the localized barrel magnetic fields affecting the side beams to vary depending on the levels of the distortions of spot shapes.

In the second color cathode-ray tube, it is preferable that the localized magnetic field formed between each of the pairs of members for generating a magnetic field is induced by a horizontal deflection magnetic field generated by the deflection yoke.

According to this, the strengths of the localized barrel magnetic fields affecting the side beams can be varied depending on the level of the horizontal deflection.

In the second color cathode-ray tube, it is preferable that the members for generating a magnetic field have plate-like magnetic bodies placed in planes perpendicular to an in-line direction and parallel to a direction in which the electron beams travel and the plate-like magnetic bodies are positioned in locations shifted inward from planes passing through the central axes of the side beams.

According to this, with a relatively simple configuration, the localized barrel magnetic fields are allowed to act on the side beams. Furthermore, by setting the space between the magnetic bodies to be narrower than that between the side beams, the strengths of the magnetic fields acting on the side beams are allowed to be uneven in cross-sectional planes of the beams and the magnetic fields act on the left and right side beams differently. Therefore, it is possible to vary one of the side beams to have a horizontally elongated cross-sectional shape and the other of the side beams to have a vertically elongated cross-sectional shape.

In the second color cathode-ray tube, it is preferable that ends, on the electron beam side, of the plate-like magnetic bodies are bent and thus planes parallel to the in-line direction are formed.

According to this, areas on which the localized barrel magnetic fields act are broadened, thus improving the effect of correcting the spot distortions.

Furthermore, in the second color cathode-ray tube, it is preferable that the members for generating a magnetic field are four substantially V-shaped magnetic pieces attached to an inner face of a cylindrical body.

According to this, the members for generating a magnetic field can be provided with a relatively simple configuration and therefore can be attached to the end of the electron gun easily.

In the second color cathode-ray tube, it also is preferable that a further pair of members for generating a magnetic field is placed above and below the center beam of the three electron beams so as to sandwich it, thus allowing a localized barrel magnetic field to act on the center beam.

According to this, the magnetic flux density affecting the center beam can be adjusted, thus providing an allowance for the adjustment of convergence.

A third color cathode-ray tube of the present invention includes an in-line electron gun. In the third color cathode-ray tube, at the end, on a screen side, of the electron gun, two pairs of plate-like members are placed above and below side beams of three electron beams so as to sandwich them, respectively. The plate-like members have plate-like magnetic bodies placed in planes perpendicular to an in-line direction and parallel to a direction in which the electron beams travel and the plate-like magnetic bodies are positioned in locations shifted inward from planes passing through the central axes of the side beams.

According to this, with a relatively simple configuration, localized barrel magnetic fields are allowed to act on the side beams. Furthermore, by setting the space between the magnetic bodies to be narrower than that between the side beams, the strengths of the magnetic fields acting on the side beams are allowed to be uneven in cross-sectional planes of the beams and the magnetic fields act on the left and right side beams differently. Therefore, it is possible to vary one of the side beams to have a horizontally elongated cross-sectional shape and the other of the side beams to have a vertically elongated cross-sectional shape. As a result, the nonuniformity in the spot shapes of the side beams can be improved.

In the third color cathode-ray tube, it is preferable that ends, on the electron beam side, of the plate-like magnetic bodies are bent and thus planes parallel to the in-line direction are formed.

According to this, areas on which the localized barrel magnetic fields act are broadened, thus improving the effect of correcting spot distortions.

Furthermore, in the third color cathode-ray tube, it is preferable that the plate-like members are four substantially V-shaped magnetic pieces attached to an inner face of a cylindrical body.

According to this, the members for generating a magnetic field can be provided with a relatively simple configuration and therefore can be attached to the end of the electron gun easily.

In the third color cathode-ray tube, it also is preferable that a further pair of plate-like members is placed above and below the center beam of the three electron beams so as to sandwich it and the plate-like members have plate-like magnetic bodies placed in a plane that is perpendicular to the in-line direction and passes through the central axis of the center beam.

According to this, the magnetic flux density affecting the center beam can be adjusted, thus providing an allowance for the adjustment of convergence.

In addition, a color cathode-ray tube apparatus of the present invention includes any one of the first to third color cathode-ray tubes and a deflection yoke for generating a pincushion-type horizontal deflection magnetic field and a barrel-type vertical deflection magnetic field.

According to this, the symmetry in the spot distortions of the side beams asymmetric with each other is improved, thus providing a color cathode-ray tube apparatus with an improved focus quality.

DETAILED DESCRIPTION OF THE INVENTION

Embodiments of the present invention are described with reference to the drawings as follows.

Embodiment 1

Figure 5:
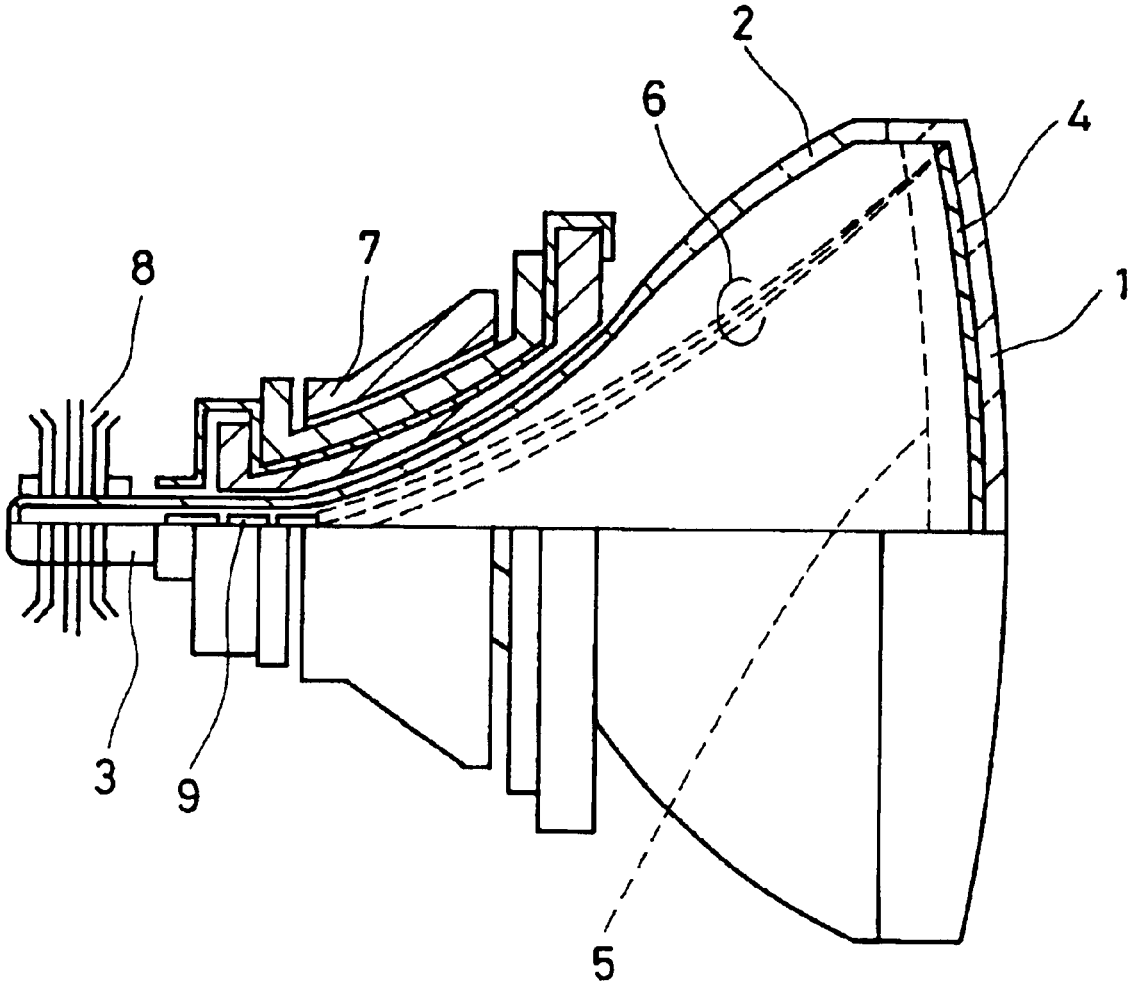
FIG. 5 shows a side view, partially in section, of a color cathode-ray tube apparatus according to the present invention.

FIG. 5 shows a side view, partially in section, of a color cathode-ray tube apparatus illustrating an embodiment of the present invention. The color cathode-ray tube apparatus includes a glass envelope formed of a rectangular panel 1 and a funnel 2 provided to form one body with the panel 1. On the inner face of the panel 1, a phosphor screen 4 made of phosphors with three colors is formed. A shadow mask 5 for color selection is attached opposing the phosphor screen 4 at a predetermined distance therefrom. Inside a neck portion 3 positioned at the rear of the funnel 2, an electron gun 9 for generating three electron beams 6 is provided. A deflection yoke 7 for deflecting three electron beams 6 vertically and horizontally and a so-called convergence yoke 8 for adjusting color position shifts and color unevenness at the center of the screen are provided around the neck portion 3.

Figure 8:
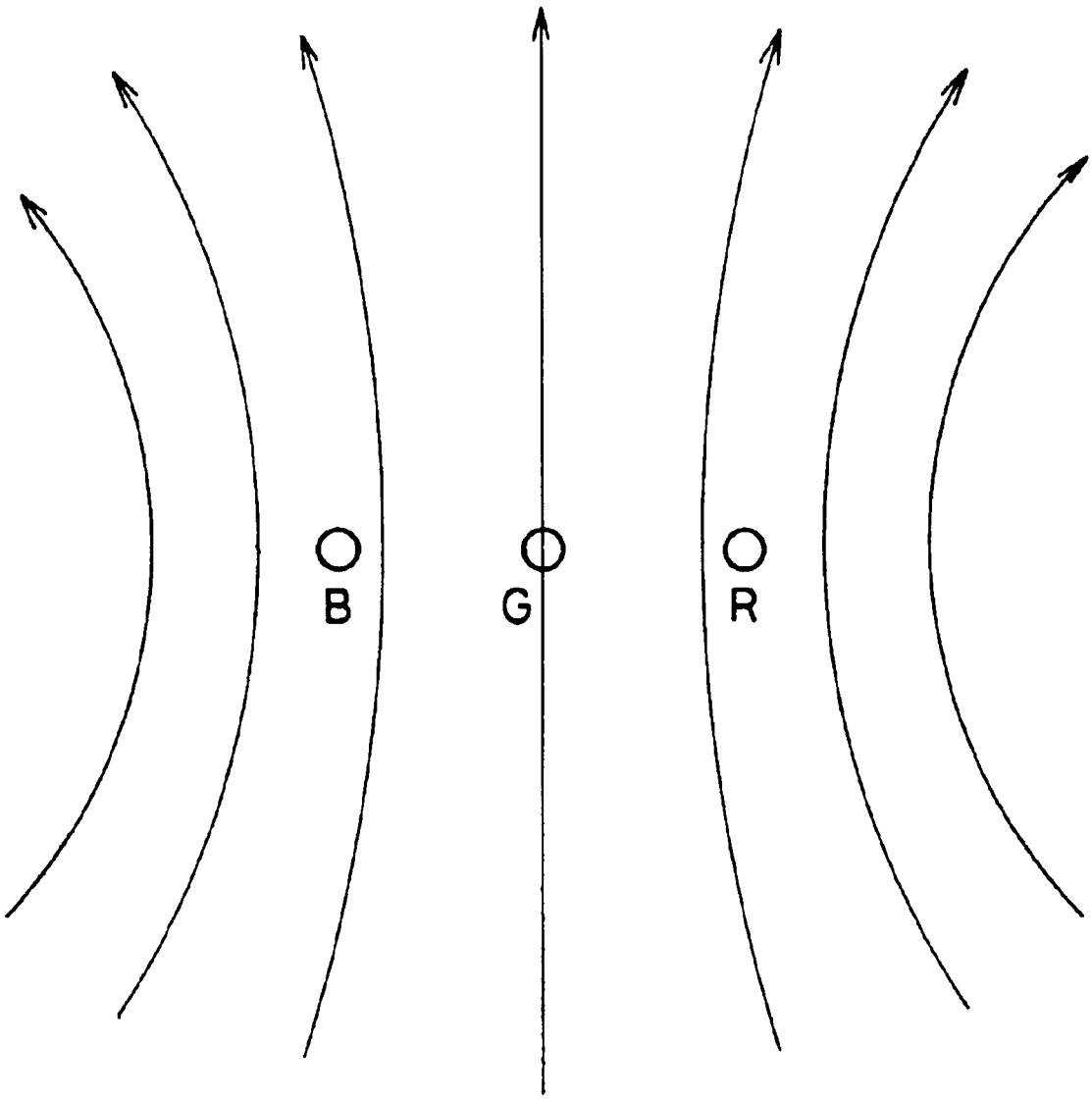
FIG. 8 PRIOR ART
FIG. 8 is a conceptual diagram of a horizontal deflection magnetic field provided with a pincushion distortion in a conventional color cathode-ray tube apparatus.
Figure 9:
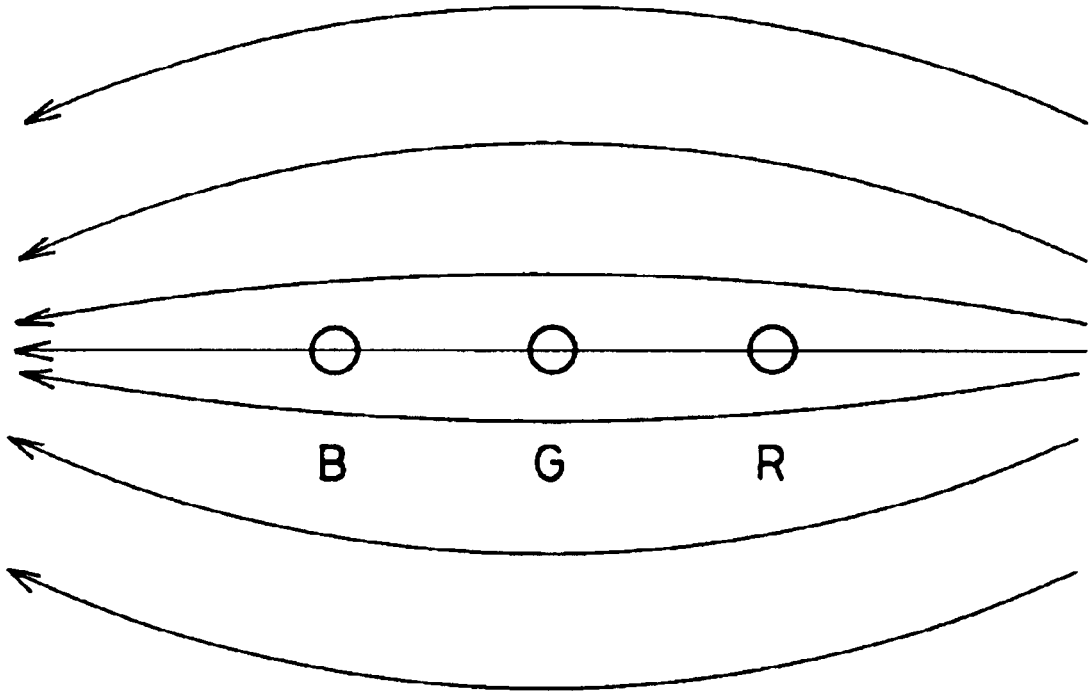
FIG. 9 PRIOR ART
FIG. 9 is a conceptual diagram of a vertical deflection magnetic field provided with a barrel distortion in the conventional color cathode-ray tube apparatus.

The deflection yoke 7 is provided with a horizontal coil (not shown in the figure) for generating a horizontal deflection magnetic field with a strong pincushion distortion (FIG. 8) and a vertical coil (not shown in the figure) for generating a vertical deflection magnetic field with a strong barrel distortion (FIG. 9) so as to deflect the three electron beams 6 and also automatically to correct color position shifts occurring throughout the screen and distortion of a raster in the upper and lower portions of the screen to obtain a straight raster.

Figure 1:
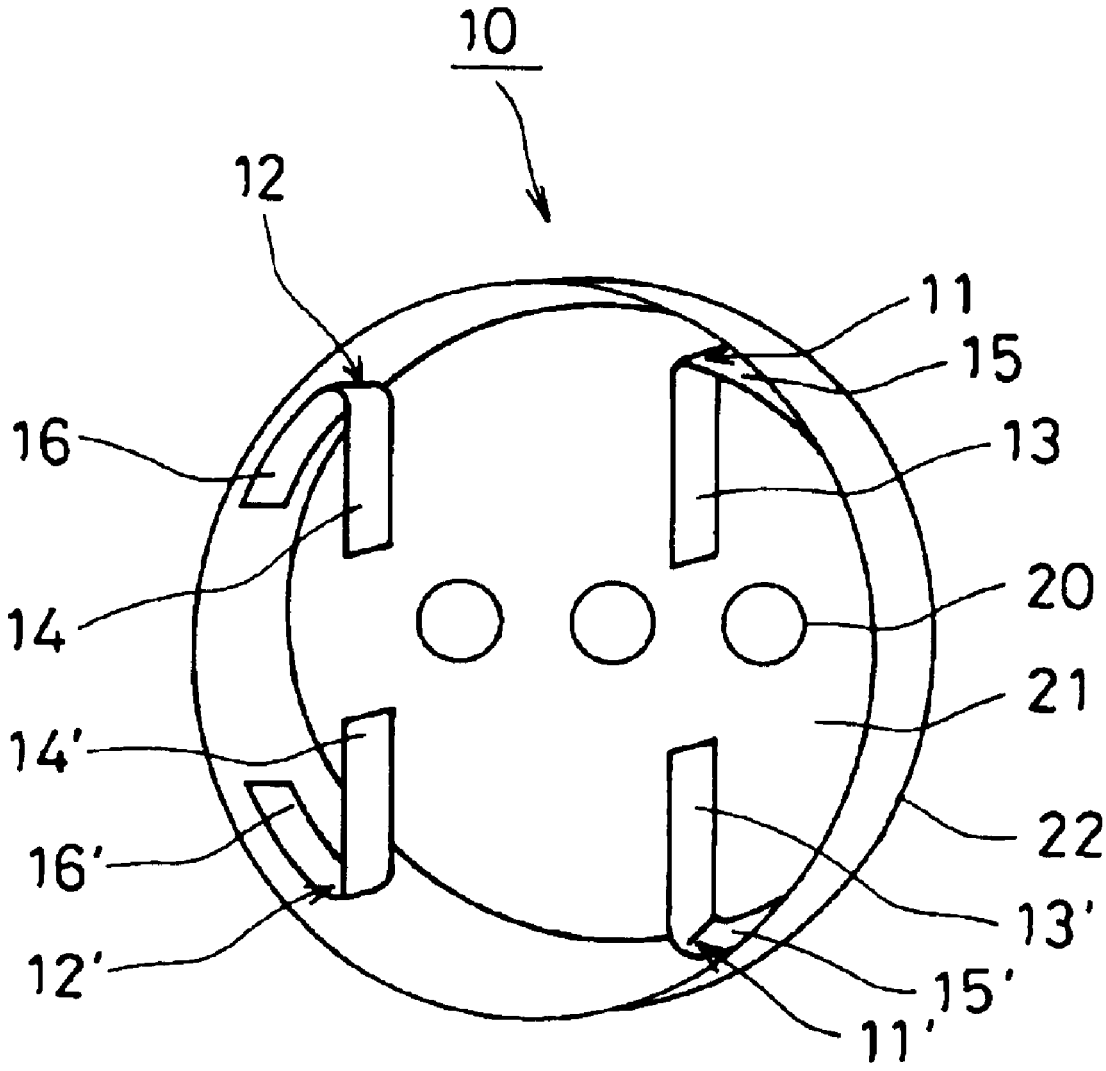
FIG. 1 is a perspective view of members for generating a magnetic field of the present invention.
Figure 2:
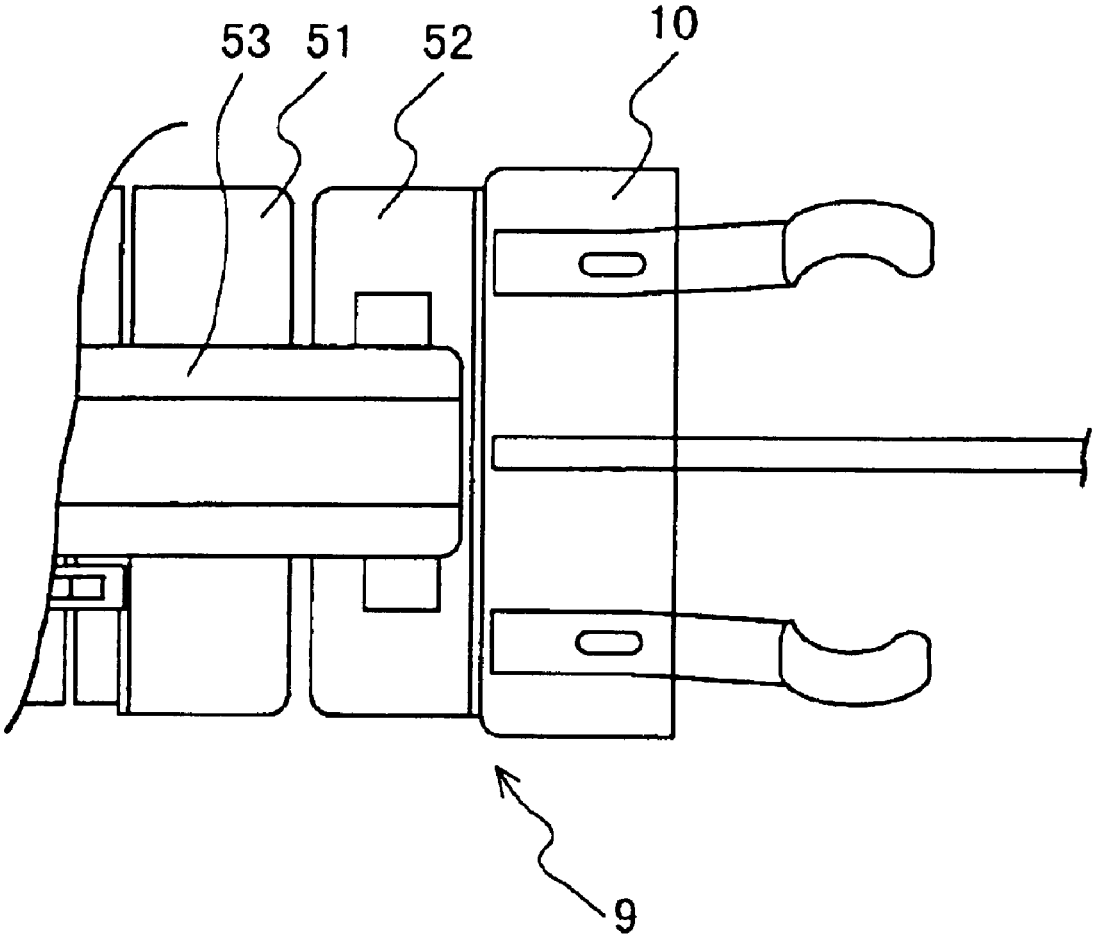
FIG. 2 is an enlarged view of an end of an electron gun.
Figure 3:
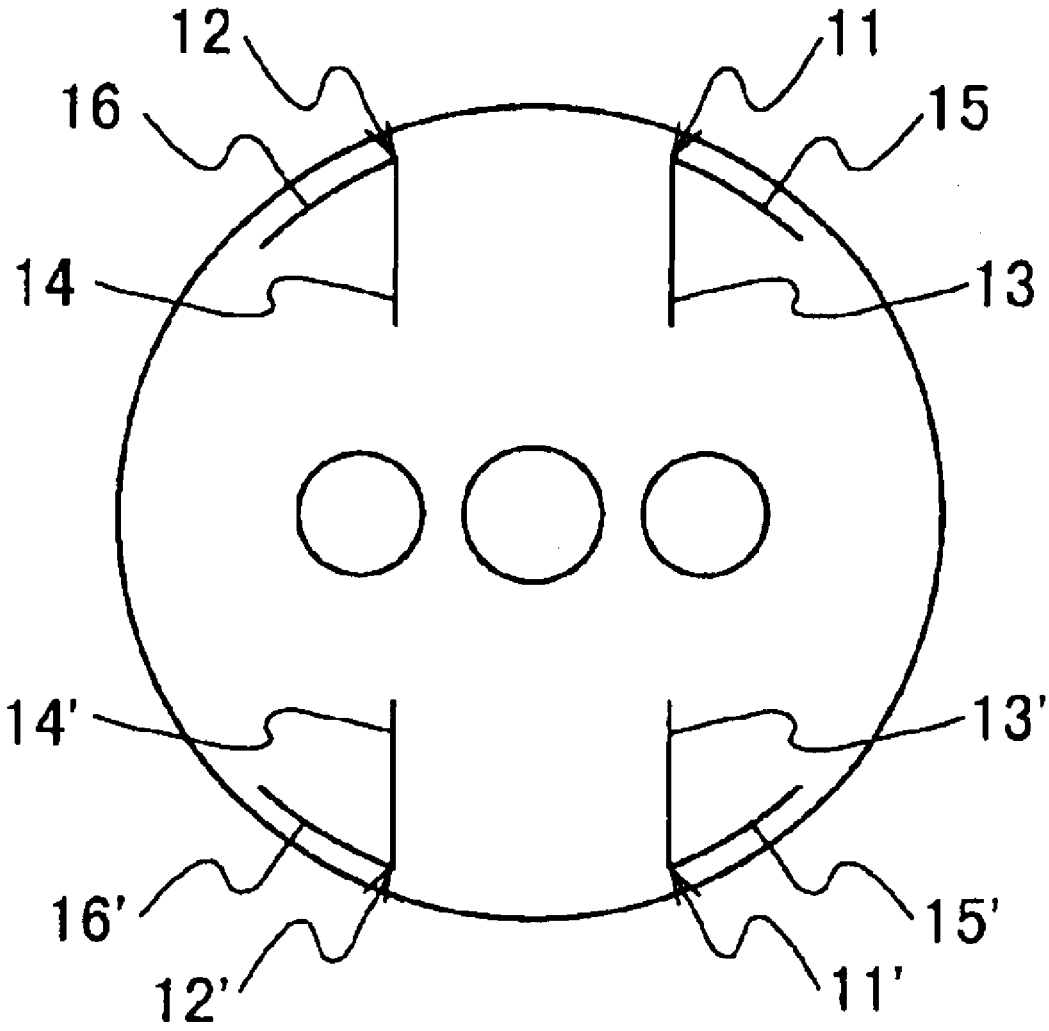
FIG. 3 is a front view of the members for generating a magnetic field of the present invention.

FIG. 2 shows an enlarged view of the end, on the screen side, of the electron gun 9. Focusing electrodes 51 and 52 are fixed to a support rod 53. To the end, on the screen side, of the focusing electrode 52, a so-called top unit 10 is fixed in a current-carrying state. As shown in FIG. 1, the top unit 10 includes a cup-shaped member having a cylindrical portion 22 and a bottom 21 provided with three electron beam through-holes 20. In the cup-shaped member, two pairs of field controllers 11, 11', 12, and 12' formed of substantially V-shaped magnetic pieces are provided as members for generating a magnetic field (plate-like members) while being in contact with and being held by the inner face of the cylindrical portion 22. The field controllers 11, 11', 12, and 12' are placed above and below side beams of three electron beams so as to sandwich them, respectively. The field controllers 11, 11', 12, and 12' have vertical planar parts 13, 13', 14, and 14' and attachment parts 15, 15', 16, and 16', respectively. The vertical planar parts 13, 13', 14, and 14' are positioned in planes perpendicular to the in-line direction (a direction in which the three electron beams are arranged) and parallel to a direction in which the electron beams travel. The attachment parts 15, 15', 16 and 16' are placed along the inner face of the cylindrical portion 22. As shown in FIG. 3, a pair of vertical planar parts 13 and 13' and a pair of vertical planar parts 14 and 14' are positioned in the same planes, respectively. The respective planes are positioned in locations shifted inward (toward the center beam) from planes that pass through the central axes of the side beams and are perpendicular to the in-line direction. They are positioned at the same interval from a vertical axis (an axis passing through a tube axis in a vertical direction).

The top unit 10 with the configuration described above is attached in an area where a horizontal deflection magnetic field is formed by the deflection yoke 7 or in the vicinity of the entrance of the area.

Figure 4:
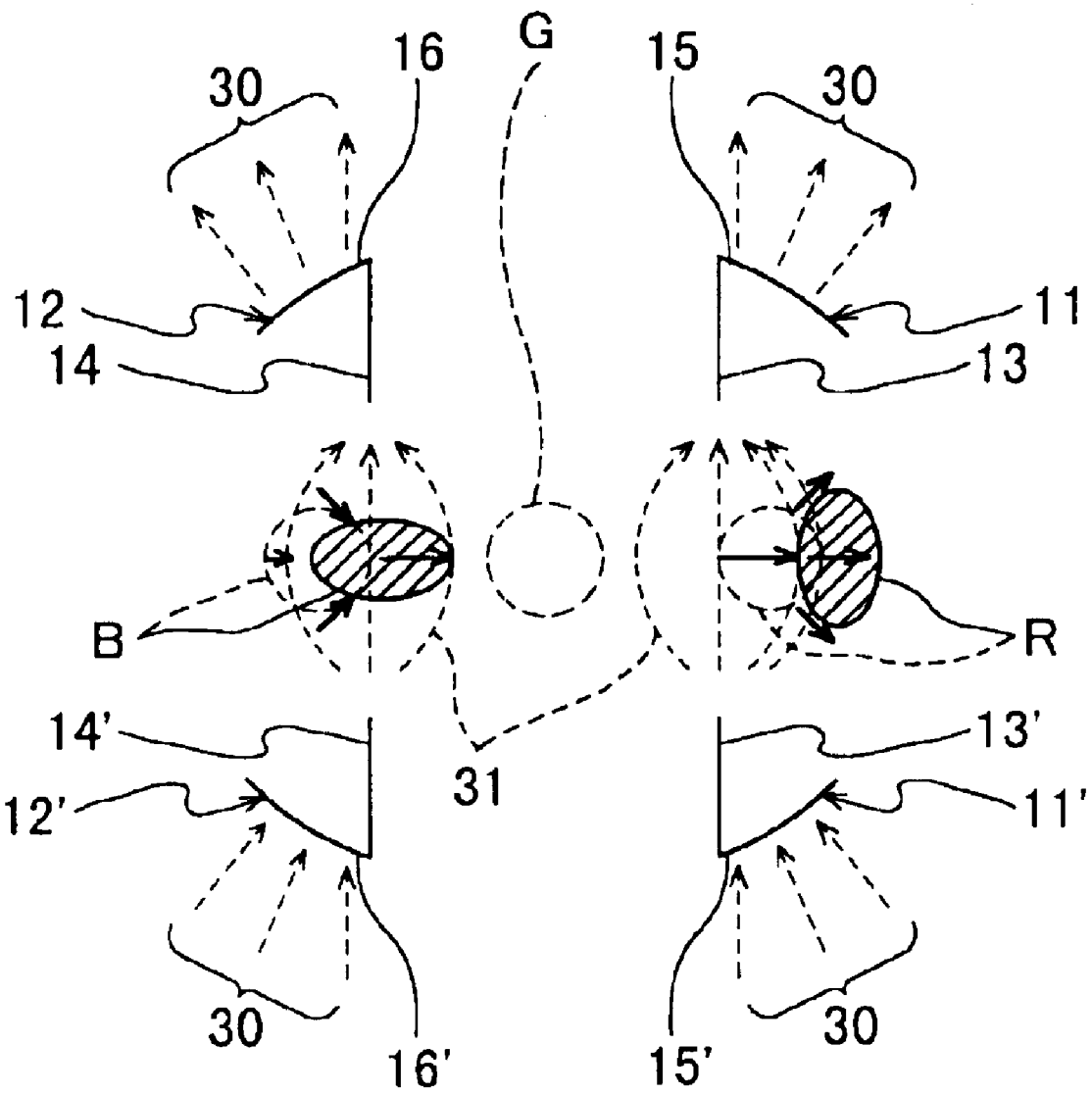
FIG. 4 shows a manner in which localized barrel magnetic fields act on side beams.

Next, a function of the field controllers is described with reference to FIG. 4.

In the case where electron beams are deflected to the right when being seen from the screen side, pincushion-type horizontal deflection magnetic fields 30 are directed upward. Initially, the magnetic fields are absorbed by the attachment parts 15' and 16' of the field controllers 11' and 12' on the lower side. The absorbed magnetic fields are transmitted from the vertical planar parts 13' and 14' to the vertical planar parts 13 and 14, and then pass through the attachment parts 15 and 16, respectively, to go out from the field controllers. Localized magnetic fields 31 formed when the absorbed magnetic fields are transmitted from the vertical planar parts 13' and 14' to the vertical planar parts 13 and 14 are formed in barrel shapes with respect to the axis extending between the vertical planar parts 13 and 13' and the axis extending between the vertical planar parts 14 and 14', respectively.

The central axes of the barrel-type localized magnetic fields 31 are positioned on the inner sides of both side beam axes. Therefore, the directions of forces acting on a red electron beam R and a blue electron beam B passing through the localized magnetic fields 31 are different from each other. When entering the localized magnetic field 31, the red electron beam R (indicated with a broken line) with a perfectly circular cross-section is subjected to a so-called barrel-type magnetic field. An outward force (indicated with an arrow) acts on the inner side (on the side of a green electron beam G) of the cross-section of the red electron beam R. On the other hand, the outer side of the cross-section is subjected to a force (indicated with arrows) in directions perpendicular to that of the magnetic field. As a result, the red electron beam R as a whole is displaced outward and the shape of its cross-section is varied to be vertically long (indicated with a solid line). When entering the localized magnetic field 31, a blue electron beam B (indicated with a broken line) with a perfectly circular cross-section is subjected to a so-called pincushion-type magnetic field. An inward force (indicated with arrows) acts on the outer side (on the opposite side to the green electron beam G) of the cross-section of the blue electron beam B. On the other hand, the inner side of the cross-section is subjected to a force (indicated with an arrow) in a direction perpendicular to that of the magnetic field. As a result, the blue electron beam B as a whole is displaced inward and the shape of its cross-section is varied to be horizontally long (indicated with a solid line). Consequently, the asymmetry in the spot distortions of the side beams with respect to each other occurring when they reach the screen is improved.

The strength of the localized magnetic fields 31 is adjusted as follows. By increasing one or both of the length and the width (the length in the tube axis direction) of the attachment parts 15, 15', 16, and 16' of the field controllers to increase the areas of the attachment parts, the absorption of the horizontal deflection magnetic field by the attachment parts is increased. Thus, the strength of the localized magnetic fields is enhanced. Further, the increase in width (the length in the tube axis direction) of the vertical planar parts 13, 13', 14, and 14' of the field controllers allows the areas where the localized magnetic fields act on the electron beams to be longer, thus obtaining a higher effect.

Preferable sizes, as examples, of the respective members of the present embodiment are described as follows. The size of the cathode-ray tube is 46 cm (19 inches). The diameter of the neck is 29.1 mm. The cylindrical portion 22 of the top unit 10 has a diameter of 21.5 mm. The width (the length in the tube axis direction) of the top unit 10 is 8 mm. Each of the attachment parts 15, 15', 16, and 16' and each of the vertical planar parts 13, 13', 14, and 14' of the V-shaped field controllers have a length of 6 mm and a length of 4.5 mm, respectively. Each field controller has a width (a length in the tube axis direction) of 3 mm and a thickness of 0.1 mm. The interval between respective centers of the electron beam through holes 20 is 5.5 mm. The diameter of each electron beam through hole 20 is 3 mm. Each space between the vertical planar parts 13 and 14, and 13' and 14' is 7 mm. Therefore, the respective vertical planar parts are positioned in locations shifted toward the center by 2 mm from the centers of the electron beam through holes on the both sides. Besides a Permalloy, other materials may be used for the field controller, 11, 11', 12, 12' and the cylindrical portion 22 of the top unit 10 as long as they are high permeability materials such as a $\mu$-Metal (a Ni42%-Fe alloy) or the like. The workability during manufacturing is improved with the increase in thickness of the respective parts of the top unit.

Figure 10:
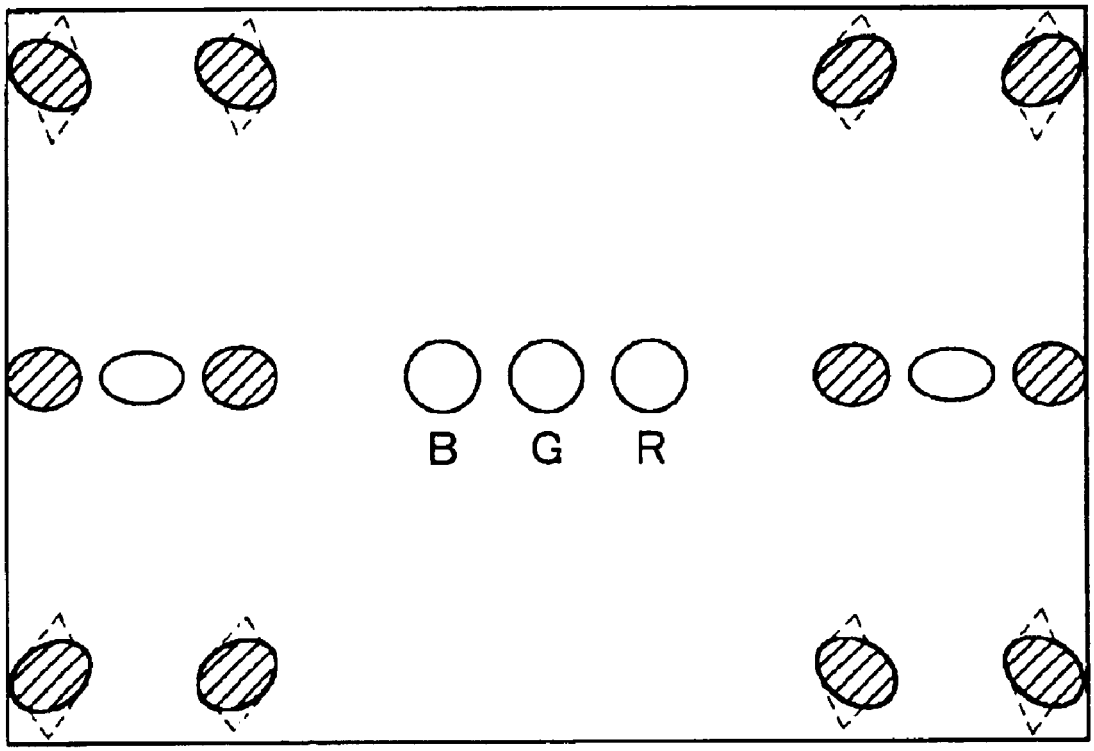
FIG. 10 is a drawing showing spot shapes in the present invention.
Figure 11:
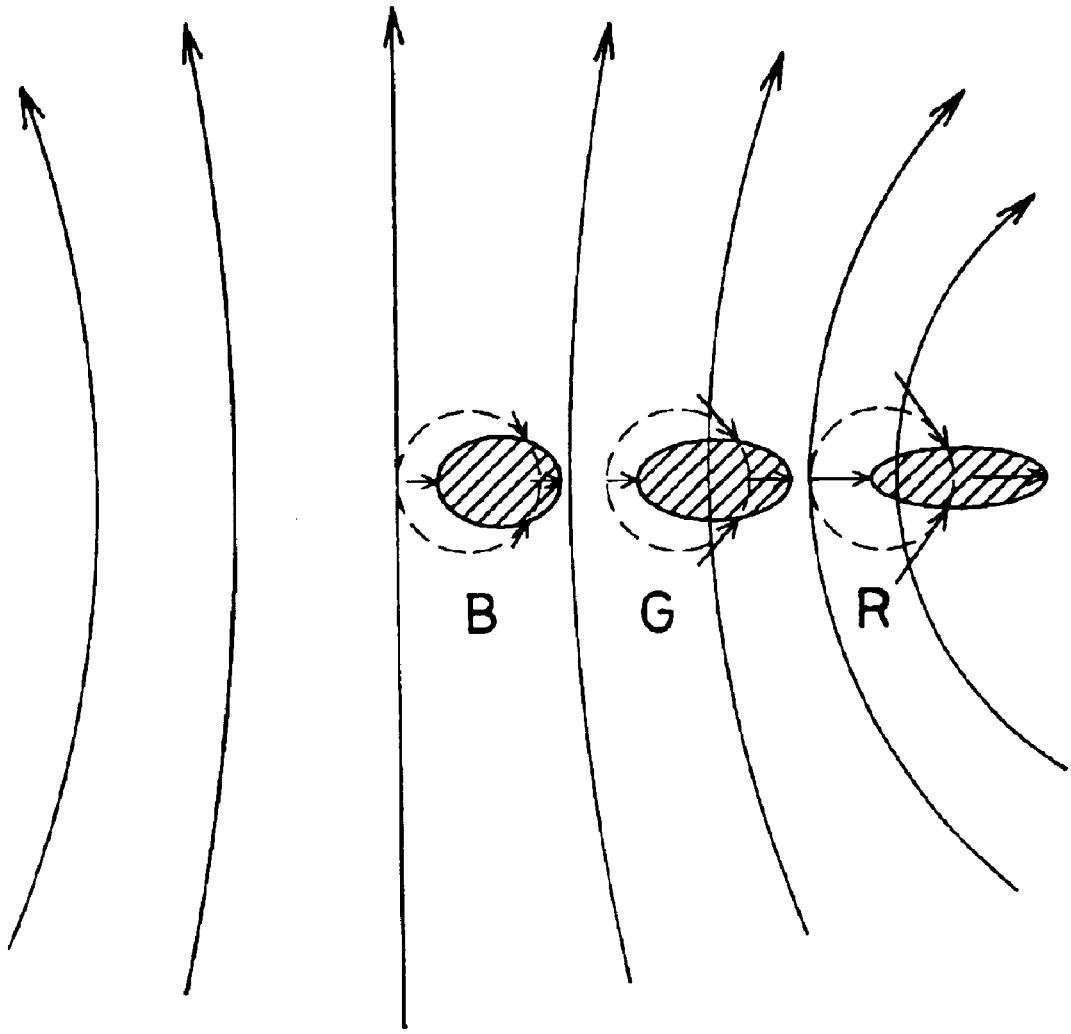
FIG . 11 PRIOR ART
FIG. 11 is a drawing showing a manner in which a horizontal deflection magnetic field acts on electron beams in the conventional color cathode-ray tube apparatus.
Figure 12:
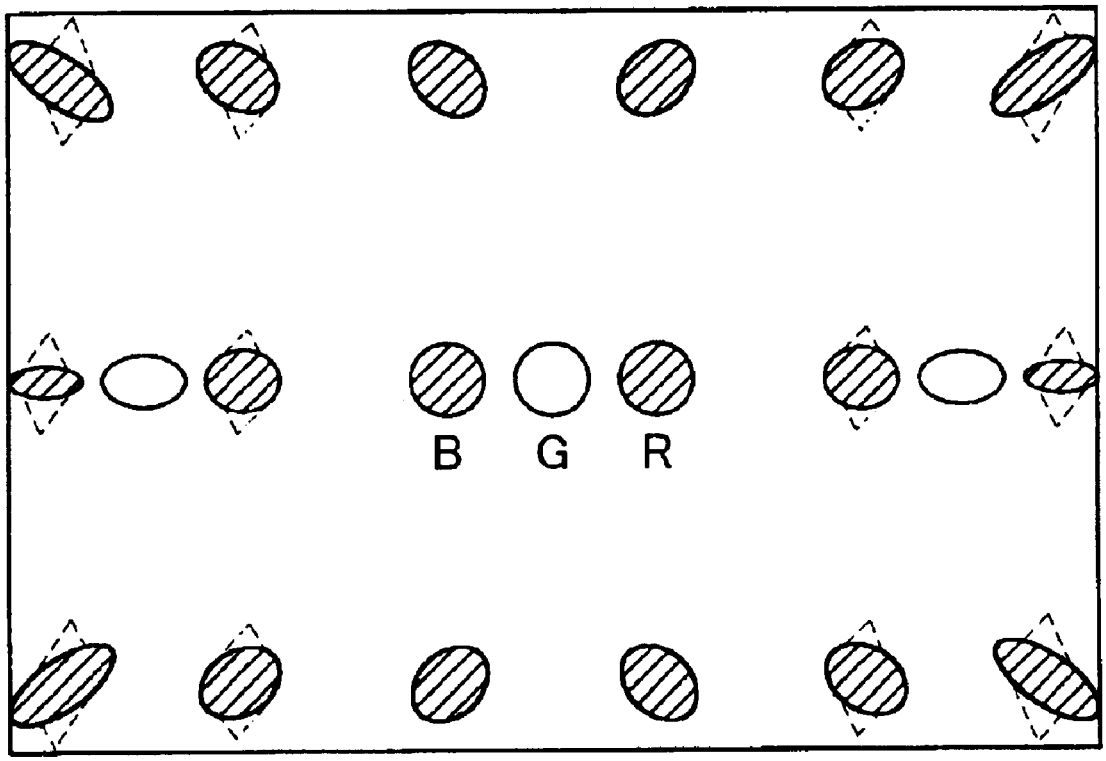
FIG. 12 PRIOR ART
FIG. 12 is a drawing showing spot shapes in the conventional color cathode-ray tube apparatus.

According to the present invention, as shown in FIG. 10, the distortions of spot shapes are corrected at the periphery of the screen and the spot shapes approach perfect circles to a higher degree compared to the conventional spot shapes shown in FIG. 12. Values indicating levels of the asymmetry include a value of a voltage (a focus voltage) applied when respective beams are focused precisely. Conventionally, with respect to a red electron beam, there has been a difference of about 200 V in focus voltages in the right and left portions of the screen. In the present invention, however, the difference is reduced to 40 V or less and thus it was made possible that the difference falls within a substantial adjustment error tolerance.

The localized magnetic fields 31 formed by the field controllers are induced by the horizontal deflection magnetic field generated by the deflection yoke 7. The strengths of the localized magnetic fields 31 vary with that of the horizontal deflection magnetic field generated by the deflection yoke 7. Generally, the level of the asymmetry in the spot distortions of side beams with respect to each other varies with that of the deflection in the horizontal direction. According to the present invention, therefore, correction can be performed depending on the level of the asymmetry.

Second Embodiment

Figure 6:
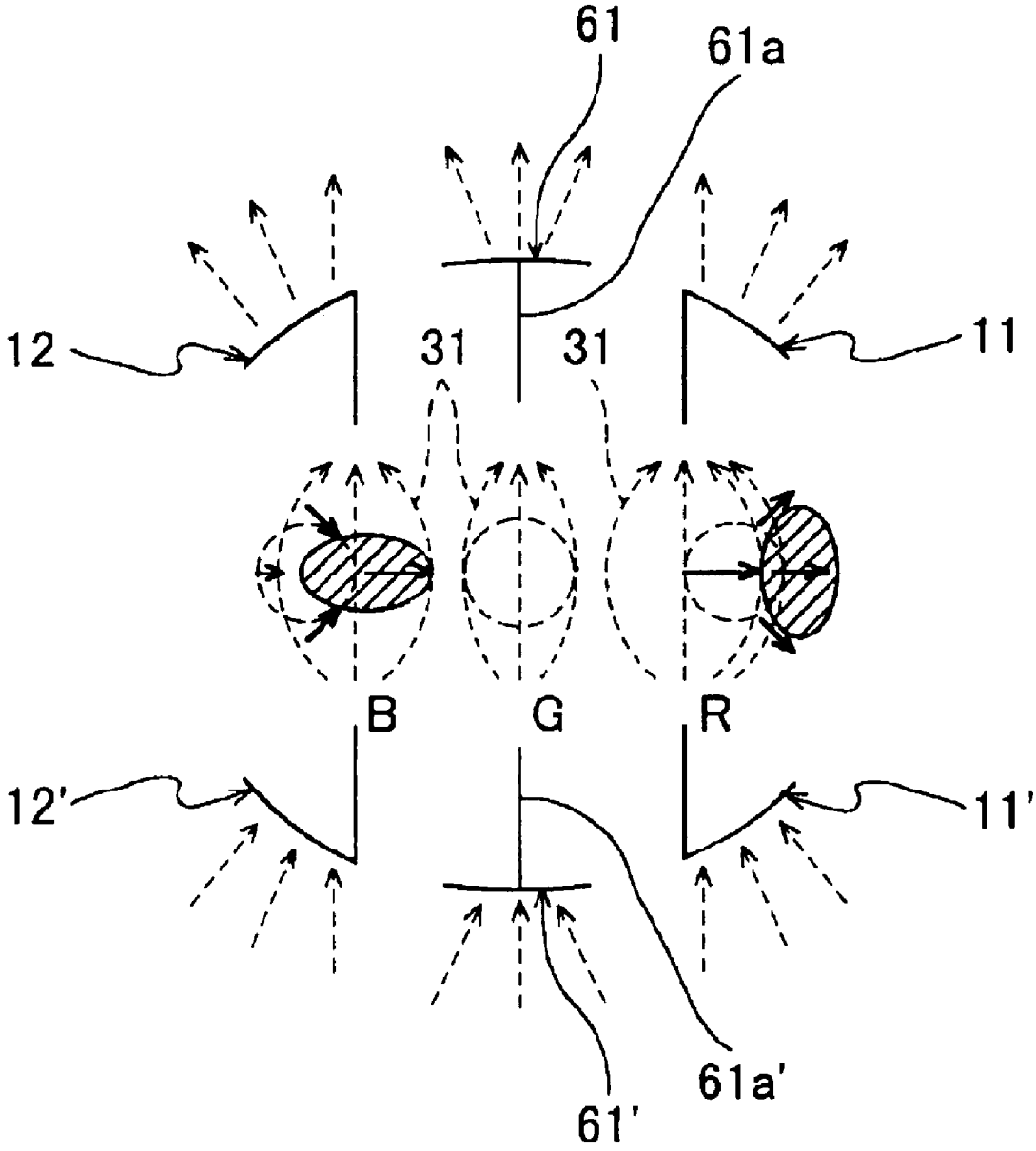
FIG. 6 is a front view of members for generating a magnetic field according to a second embodiment of the present invention.

In the present embodiment, as shown in FIG. 6, substantially T-shaped field controllers 61 and 61' are provided on the vertical axis in addition to the above-mentioned V-shaped field controllers 11, 11', 12, and 12' to adjust the magnetic flux density affecting the center beam relative to that affecting the side beams. Thus, an allowance for the adjustment of convergence is provided.

When a localized magnetic field corresponding to the center green electron beam G is generated, the localized magnetic field is superimposed on a horizontal deflection magnetic field acting on the green electron beam G. Therefore, the level of the horizontal deflection of the green electron beam G is increased. Consequently, the misconvergence that a vertical line of the green electron beam G is displayed in a location inward with respect to vertical lines of the blue electron beam B and the red electron beam R can be corrected in both left and right end portions of the screen.

In the respective T-shaped field controllers 61 and 61', a part attached to a cylindrical portion has a length of 4 mm and the length of vertical planar parts 61*a* and 61*a'* is 7.5 mm. The vertical planar parts 61*a* and 61*a'* are placed in a plane that is perpendicular to the in-line direction and passes through the central axis (a tube axis) of the center beam.

Third Embodiment

Figure 7:
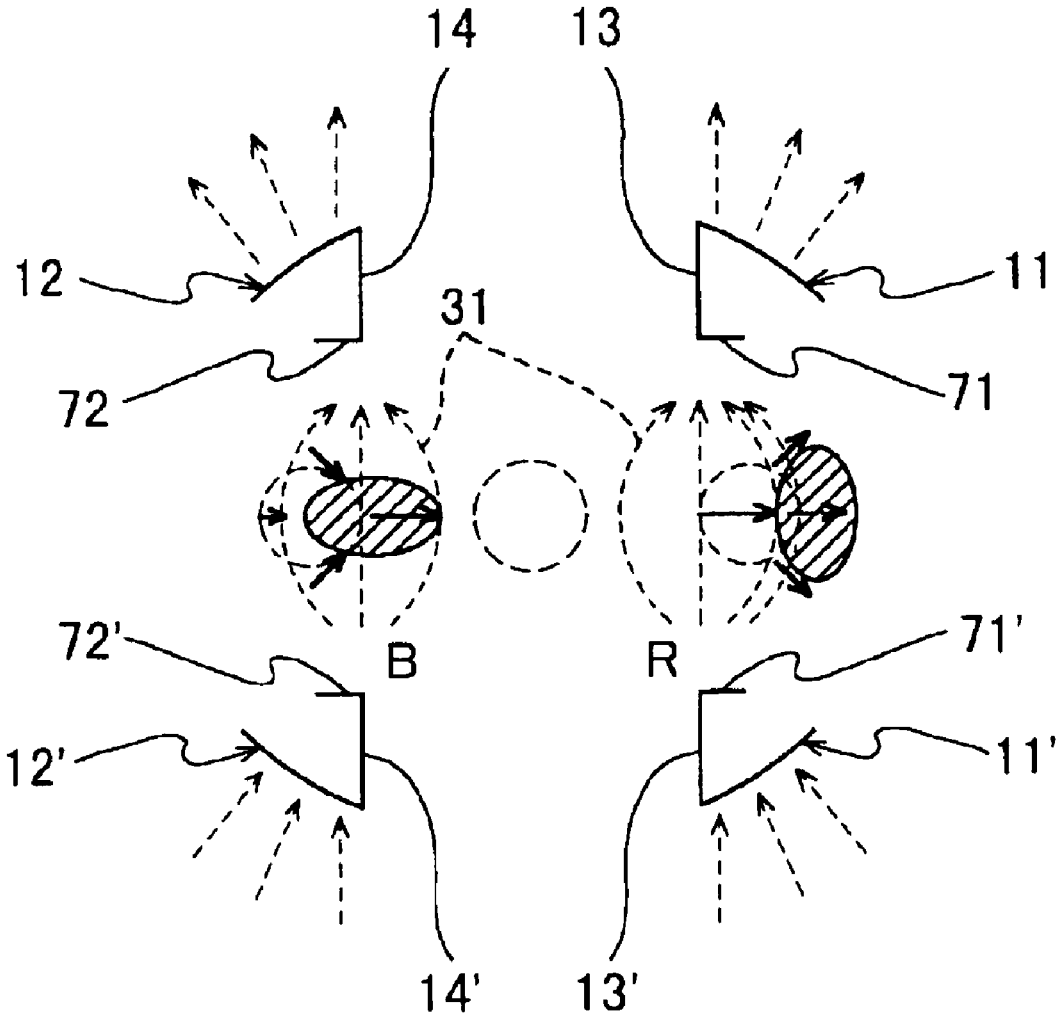
FIG. 7 is a front view of members for generating a magnetic field according to a third embodiment of the present invention.

In the present embodiment, as shown in FIG. 7, ends of respective vertical planar parts 13, 13' 14, and 14' of field controllers are bent outward to provide bent parts 71, 71', 72, and 72', with a length of about 2 mm, substantially parallel to the in-line direction, thus broadening the areas of magnetic fields to be generated.

According to the present embodiment, the areas of magnetic fields acting on beams are broadened and the effect of correcting spot shapes is improved when compared to the case where the bent parts 71, 71', 72, and 72 are not provided. In this case, it is preferable that with respect to the inline direction, the tips of the bent parts 71, 71', 72, and 72 are positioned on the central axes of the side beams B and R.

In the present embodiment, the T-shaped field controllers 61 and 61' for generating a localized magnetic field acting on the center beam as described in the second embodiment also may be provided.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A color cathode-ray tube comprising an in-line electron gun, and means for passing side beams of three electron beams through localized bipolar barrel magnetic fields formed in a direction substantially perpendicular to an in-line plane corresponding to the side beams, respectively, varying cross-sectional shapes of the side beams so that the cross-sectional shape of one of the side beams is horizontally or vertically elongated to a higher degree than that to which the cross-sectional shape of the other of the side beams is, and displacing the side beams as a whole in a direction parallel to the in-line plane.

2. A color cathode-ray tube apparatus comprising:

a color cathode-ray tube according to claim 1; and a deflection yoke for generating a pincushion horizontal deflection magnetic field and a barrel vertical deflection magnetic field.

3. A color cathode-ray tube comprising an in-line electron gun, wherein at an end, on a screen side, of the electron gun, two pairs of members for generating a magnetic field are placed above and below side beams of three electron beams so as to sandwich them, respectively, in locations shifted inward from planes passing through central axes of the side beams, and between each of the two pairs of members for generating a magnetic field, a localized bipolar barrel magnetic field is formed to vary cross-sectional shapes of the side beams so that the cross-sectional shape of one of the side beams is horizontally or vertically elongated to a higher degree than that to which the cross-sectional shape of the other of the side beams is and to displace the side beams as a whole in a direction parallel to the in-line plane.

4. The color cathode-ray tube according to claim 3, wherein a strength of the localized magnetic field formed between each of the two pairs of members for generating a magnetic field varies depending on a level of horizontal deflection.

5. The color cathode-ray tube according to claim 3, wherein the localized magnetic field formed between each of the two pairs of members for generating a magnetic field is induced by a horizontal deflection magnetic field generated by a deflection yoke.

6. The color cathode-ray tube according to claim 3, wherein the two pairs of members for generating a magnetic field have plate magnetic bodies placed in planes perpendicular to an in-line direction and parallel to a direction in which the three electron beams travel, and the plate magnetic bodies are positioned in locations shifted inward from planes passing through central axes of the side beams.

7. The color cathode-ray tube according to claim 6, wherein ends, on a side of the electron beams, of the plate magnetic bodies are bent and planes parallel to the in-line direction are formed.

8. The color cathode-ray tube according to claim 3, wherein the two pairs of members for generating a magnetic field are four substantially V-shaped magnetic pieces attached to an inner face of a cylindrical body.

9. The color cathode-ray tube according to claim 3, wherein a further pair of members for generating a magnetic field is placed above and below a center beam of the three electron beams so as to sandwich it, thus allowing a localized barrel magnetic field to act on the center beam.

10. A color cathode-ray tube apparatus comprising:

a color cathode-ray tube according to claim 3; and a deflection yoke for generating a pincushion horizontal deflection magnetic field and a barrel deflection magnetic field.

11. A color cathode-ray tube comprising an in-line electron gun, wherein at an end, on a screen side, of the in-line electron gun, two pairs of plate members are placed above and below side beams of three electron beams so as to sandwich them, respectively, the two pairs of plate members have plate magnetic bodies placed in planes perpendicular to an in-line direction and parallel to a direction in which the three electron beams travel, the plate magnetic bodies are positioned in locations shifted inward from planes passing through central axes of the side beams, and a bipolar barrel magnetic field for displacing the side beams as a whole in a direction parallel to the in-line plane is formed between the plate magnetic bodies.

12. The color cathode-ray tube according to claim 11, wherein ends, on a side of the electron beams, of the plate magnetic bodies are bent and planes parallel to the in-line direction are formed.

13. The color cathode-ray tube according to claimed 11, wherein the two pairs of plate members are four substantially V-shaped magnetic pieces attached to an inner face of a cylindrical body.

14. The color cathode-ray tube according to claim 11, wherein a further pair of plate members is placed above and below a center beam of the three electron beams so as to sandwich it, and the further pair of plate members has plate magnetic bodies placed in a plane that is perpendicular to the in-line direction and passes through a central axis of the center beam.

15. A color cathode-ray tube apparatus comprising:

a color cathode-ray tube according to claim 11; and a deflection yoke for generating a pincushion horizontal deflection magnetic field and a barrel deflection magnetic field.

* * * * *